United States Patent [19]

Austin et al.

[11] Patent Number: 4,509,690

[45] Date of Patent: Apr. 9, 1985

[54] CARBONATED BEVERAGE MIXING NOZZLE FOR A DISPENSER

[75] Inventors: Forrest L. Austin, Brooklyn Center; Jerald R. Bebeau, Coon Rapids, both of Minn.

[73] Assignee: The Cornelius Company, Anoka, Minn.

[21] Appl. No.: 447,380

[22] Filed: Dec. 6, 1982

[51] Int. Cl.[3] ..... B05B 7/06

[52] U.S. Cl. ..... 239/429; 222/566; 222/129.1

[58] Field of Search ..... 239/429, 430, 10, 425, 239/424.5, 424, 398; 222/566, 129, 330, 331, 129.1, 129.2, 129.3, 129.4

[56] References Cited

U.S. PATENT DOCUMENTS

| | | | |
|---|---|---|---|
| 725,134 | 4/1903 | Proper | 239/430 |
| 1,465,194 | 8/1923 | Tirrell | 239/430 |
| 1,968,126 | 7/1934 | Center | 239/430 |
| 2,376,413 | 5/1945 | Babcock | 239/430 |

*Primary Examiner*—Joseph J. Rolla
*Assistant Examiner*—Kenneth Noland
*Attorney, Agent, or Firm*—Henry C. Kovar

[57] ABSTRACT

An improved mixing nozzle for a post-mix beverage dispenser having a water supply chamber co-axially surrounding a syrup supply port, has an elongate syrup diffuser having a spray head on its lower end, an upper water distribution disc on the diffuser having a plurality of apertures having a cumulative opening area for passage of water, a convex frusto-conical water spreader is directly below the upper disc, a lower water distribution disc is spaced below the upper disc and the spreader, the lower disc has a plurality of apertures and a clearance between itself and a nozzle spout, the cumulative area of the lower disc apertures and spout clearance is several times the area of the upper disc apertures, an enlarged water plenum is between the spreader and the lower disc, and the syrup diffuser has outlets to spray syrup into a water stream below the lower disc.

11 Claims, 4 Drawing Figures

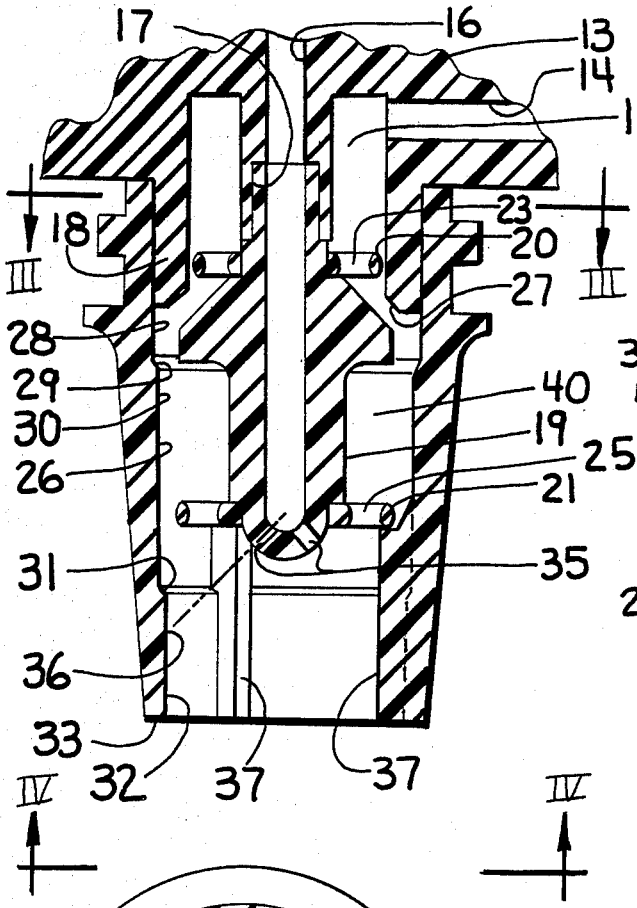
FIG. 1
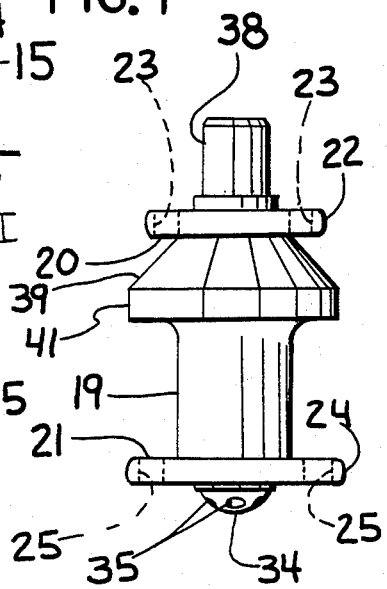
FIG. 2
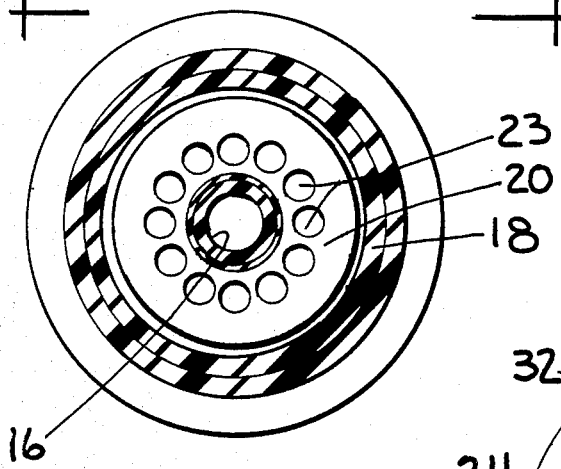
FIG. 3
FIG. 4
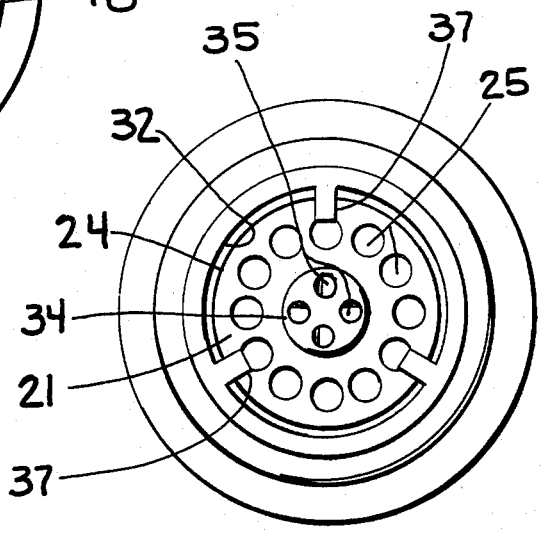

CARBONATED BEVERAGE MIXING NOZZLE FOR A DISPENSER

BACKGROUND OF THE INVENTION

1. Field of the Invention

This invention pertains to a mixing nozzle for a carbonated beverage dispenser, more particularly to a nozzle in which carbonated water and syrup are mixed during dispensing, typically from a post-mix valve.

2. The Prior Art

There are numerous examples of mixing nozzles for carbonated beverage dispensers. The nozzles are usually for use on post-mix dispensing valves. A post-mix dispensing valve combines carbonated water and syrup to form a carbonated soft drink.

The criteria for soft drink mixing nozzles are well known. The nozzle must dispense without foaming. The nozzle should have a stable and aesthetically pleasing flow pattern for the operator, customer, and prospective customer to watch. The nozzle must produce a good mix of water and syrup and must not give a stratified drink. A stratified drink has too much syrup in the bottom and not enough syrup at the top. When you consume a stratified drink, the first part tastes like charged water and the last part tastes too sweet and too low in carbonation. The nozzle must give a drink that has high carbonation retention. The nozzle should be sanitary and be easily cleaned. The nozzle should be drip-free and should empty fast upon termination of dispensing. The nozzle should effectively mix the initial flow of water and syrup when the valves are opened and should wash itself of syrup when the valves are closed. The nozzle should have a straight flow pattern that does not spiral, roll or gurgle and should effect minimum motion in a cup. A nozzle has to be economically viable; it cannot be complicated in construction nor complicated to use. A nozzle has to be able to interchangeably handle sugartype or dietetic soft drinks and high or low carbonation water. High carbonated water is used for colas, lemon-limes, and root beer; low carbonated water is used for orange, grape and other fruit beverages. Further, a nozzle should be able to handle pulp type concentrates such as orange juice, tomato or Bloody Mary mix, grapefruit juice and the like.

The criteria are easy to list but very difficult to obtain. A current trend in beverage dispensing is to double the fill rates from 1.5 oz/sec to 3.0 oz/sec. These are now referred to as standard flow and high flow dispensing respectively.

A satisfactory nozzle for both high and low flows has yet to meet the above criteria to the satisfaction of soft drink parent companies.

OBJECTS OF THE INVENTION

It is an object of the present invention to provide an improved mixing nozzle for dispensing beverages made of water and syrup.

It is an object of the present invention to provide an economical mixing nozzle for carbonated beverage that does not foam, gives a well mixed drink without stratification, that is sanitary and easily cleaned, that does not drip, that has a pleasing operation, and that will dispense either high or low flow rates of dispensing.

SUMMARY OF THE INVENTION

An improved mixing nozzle for a post-mix beverage dispenser having a water outlet co-axially surrounding a syrup outlet, has a syrup diffuser with a spray head in a lower end, an upper water distribution disc in the water outlet has a plurality of water openings and a lower water distribution disc is spaced below the upper disc and is immediately above the syrup spray head, the lower disc has a plurality of water openings around the syrup diffuser and the lower disc water openings have a greater cumulative area than the upper disc openings.

BRIEF DESCRIPTION OF THE DRAWINGS

FIG. 1 is a cross-sectional elevational view of the preferred embodiment of an improved mixing nozzle according to the principles of the present invention;

FIG. 2 is an elevational view of the diffuser assembly in the nozzle of FIG. 1;

FIG. 3 is a cross-sectional plan view taken through lines III—III in FIG. 1; and FIG. 4 is an upward looking plan view taken from lines IV—IV in FIG. 1

AS SHOWN ON THE DRAWINGS

The principles of the present invention are particularly useful when embodied in a beverage dispensing and mixing nozzle as shown in FIG. 1 and generally indicated by the numeral 10. The nozzle 10 has a diffuser assembly 11 and a spout 12 secured to dispenser structure 13 for dispensing beverage which in this case is the body of a post-mix beverage dispensing valve for carbonated beverage.

The dispenser 13 has a water supply port 14 leading into an annular supply chamber 15, a syrup supply port 16 leading to a pocket 17 for receiving the diffuser assembly 11, and an annular ring 18 for receiving the spout 12.

The diffuser assembly 11 has an elongated body syrup diffuser 19 to which is sonically welded an upper water distribution disc 20 and a lower water distribution disc 21. The upper disc 21 has an outside diametric surface 22 sized to slip-fit within the supply chamber 15, and a circular pattern of a dozen equally spaced water apertures 23 around the syrup diffuser 19 but inside of the ring outer surface 22. All edges formed by the outer surface 22 and the water aperture 23 are slightly rounded. The preferred size for the water aperture 23 is 0.086 inch diameter and the twelve apertures 23 have a cumulative area of 0.070 square inches. The upper disc 20 is 0.617 inches in diameter and is slip-fitted in a supply chamber 15 of 0.63 inch diameter. The lower water disc 21 has a diametric surface 24 of 0.728 inch diameter and a series of water apertures 25 in a circular pattern around the syrup diffuser 19. The lower disc water apertures 25 are also twelve in number and have a preferred diameter of 0.104 inch diameter giving a cumulative area of 0.102 square inches. The edges formed by the lower disc surface 24 and apertures 25 are also rounded.

The interior surfaces of the water supply chamber 15 and the spout 12 bound and form a nozzle water outlet 26. The water outlet 26 starts with the surfaces of the water supply chamber 15 and descends to a concave frusto-conical surface 27 and then to an upper and expanded diametric spout surface 28, then over an inward facing upper step 29 to a central diametric spout surface 30, then over an inward facing lower step 31 to an outlet diametric surface 32. The lower water disc diametric surface 24 at 0.728 inch diameter is fitted within a water outlet 26 diameter of 0.844 inch. The area between the lower disc surface 24 and the water outlet 10 is 0.143 square inches, and the combined area with the area of the water apertures 25 is 0.245 square inches. The cumulative area of the lower disc water apertures 25 is in the range of one and one-quarter to two times the cumulative area of the upper disc water apertures 23. The cumulative area of the lower disc water apertures 25 and the annular clearance between the lower water disc 21 and the water outlet central surface 30 is in the range of three to five times the area of cumulative equivalent area in the upper disc 20 which is the cumulative area of the water apertures 20 and the clearance between the upper disc 20 and the water supply chamber 15. The area of the clearance between the lower disc 21 and the water outlet central surface 30 is greater than the cumulative area of the lower disc water apertures 25. The outlet surface 32 diameter at 0.797 inches is larger than the diameter of the lower disc 21. The lower inward facing step 31 is positioned underneath the lower disc 21 and is nearer to the lower disc 21 than to the bottom 33 of the water outlet 26. The syrup diffuser 19 has at its bottom a spray head 34 having outlets 35 focused upon the outlet surface 32 at a point in intersection 36 well below the lower step 31. Also in the water outlet 26 are vanes 37 which engage the lower disc 21 from below and retain the entire diffuser assembly 19 with the discs 20, 21 in the water outlet 26, the spout 12 being fastenable to the dispenser 13 by a positive displacement quarter-turn mechanism (not shown). The syrup diffuser 19 has a connector 38 on its upper end for a snap-in fluid tight connection to the pocket 17 of the syrup supply port 16.

A generally convex frusto-conical water spreader 39 is directly underneath the upper disc 20 and its water apertures 23. The spreader 39 has a minor diameter starting within the minimum diameter of the upper disc apertures 23 so that the spreader 39 is completely under all of the area of the apertures 23. The spreader 39 extends outwardly to a larger diameter than the upper disc 20 and into the upper and expanded diameter section 28 of the water outlet 26. The upper step 29 is underneath the spreader 39 for directing water flow under the spreader 39 and off of the surface of the water outlet 26.

A water plenum 40 is in between the spaced apart discs 20, 21, and is in between the spreader 39 and the lower disc 21. The plenum 40 is a toroid having a height in the range of $1\frac{1}{2}$ to $2\frac{1}{2}$ times its cross-sectional thickness as measured radially from the syrup diffuser 19 to the water outlet central surface 30.

The cross-sectional area of the water outlet 26 gradually increases in area between the spreader 39 and convex surface 27 to a larger section area in between a spreader shoulder 41 and the expanded diameter surface 28, and then at the entry to the plenum 40. The cross-sectional area then further increases in the plenum 40 and then decreases in the lower disc 21.

The operation of the improved mixing nozzle 10 is not well understood, for in many instances it seems to defy known successful principles. Regardless, the mixing nozzle does work and successfully attains every criteria so far known. It is thought that during dispensing, carbonated water, hereinafter simply referred to as "water", comes down the port 14 and into the supply chamber 15 under most of a supply pressure. The upper disc 20 distributes the flow evenly through each of the apertures 23 and between the diameter surface 22 and chamber 15 surface. The water is then spread out in an expanding conical flow over the spreader 39 and under the convex surface 27. The water then impinges on the expanded diameter 28 and is turned around the spreader shoulder 41 and under the spreader 39 by the upper step 29. During this flow there is a substantial pressure drop and substantial reduction in flow velocity. The water is discharged off of the upper step 29 and into the plenum 40. The pressure in the plenum 40 has not been measured but it is thought to be only slightly above atmospheric. The water then backs up on top of the lower water distribution disc 21 and passes through the lower disc apertures 25 and the clearance between the diametric surface 24 and the spout surface 30. The water flow through and past the lower disc 21 is very well distributed, smooth and straight, and of low velocity. The water that has flowed around the lower disc 21 is then turned in by the lower step 31. The syrup is sprayed into the water stream at a point 36 below the lower step 31.

Future work may develop a better explanation of the working of this mixing nozzle 10, but at this time, the foregoing explanation of its operation is thought to be generally correct. The mixing nozzle works exceptionally well with both high and low flow rates.

For sanitation, the nozzle 10 can be disassembled by removing the spout 12 and grasping the diffuser assembly 11 by the lower disc 21, pulling out the diffuser assembly 11, and then washing and reassembling the parts. It's very quick and there are no small parts to lose or that need replacement.

Although various minor modifications may be suggested by those versed and experienced in the art, be it understood that we wish to embody within the scope of the patent warranted hereon all such embodiments as reasonably and properly come within the scope of our contribution to the art.

We claim as our invention:

1. An improved carbonated beverage mixing nozzle in a post-mix carbonated beverage dispenser, said nozzle having a carbonated water supply chamber co-axially surrounding a syrup supply port, said nozzle comprising:

(a) a syrup diffuser having an elongate tubular body and a spray head in a lower end for spraying syrup outwardly from the diffuser and into a water stream around the diffuser;

(b) an upper carbonated water distribution disc, said disc having an outer diameter loosely fitted into the water supply chamber, and a plurality of water apertures in a circular pattern between the syrup diffuser and the disc outer diameter;

(c) a generally frusto-conical carbonated water spreader underneath the upper disc water apertures, said spreader tapering outwardly and downwardly to an outer diameter that is larger than the upper disc and longer than the largest diameter of the circular pattern of the upper disc water apertures; there being a larger clearance between the spreader and a carbonated water outlet around the spreader, than between the upper disc and the supply chamber;

(d) a lower carbonated water distribution disc immediately above the syrup spray head, said lower disc having an outer diameter with a greater clearance with the water outlet than a clearance between the upper disc and the supply chamber said lower disc having a plurality of water apertures in a circular pattern between the syrup diffuser and the disc outer diameter, said lower disc apertures having a greater cumulative area than the upper disc apertures.

2. The nozzle of claim 1, in which said syrup diffuser body has a snap-fit connector means above the upper disc for connection to the syrup supply port, said upper disc being mounted on said syrup diffuser between the water spreader and the connector means.

3. An improved carbonated beverage mixing nozzle in a post-mix carbonated beverage dispenser, having a carbonated water supply chamber co-axially surrounding a syrup supply port, comprising:

(a) a syrup diffuser having an elongate tubular body and a spray head in a lower end for spraying syrup outwardly from the diffuser and into a water stream;

(b) an upper carbonated water distribution disc, said disc having an outer diameter fitted into the water supply chamber and a plurality of water apertures in a circular pattern between the syrup diffuser and the disc outer diameter;

(c) a generally frusto-conical carbonated water spreader underneath the upper disc water apertures, said spreader tapering outwardly and downwardly to an outer diameter that is larger than the largest diameter of the circular pattern of the upper disc water apertures; there being a larger clearance between the spreader and a carbonated water outlet around the spreader, than between the upper disc and the supply chamber;

(d) a lower carbonated water distribution disc immediately above the syrup spray head, said lower disc having an outer diameter with a greater clearance with the water outlet than a clearance between the upper disc and the supply chamber, said lower disc having a plurality of water apertures in a circular pattern between the syrup diffuser and the disc outer diameter, said lower disc apertures having a greater cumulative area than the upper disc apertures; and (e) an inward facing step in the water outlet and under the lower disc, for diverting carbonated water flow under the lower disc and off of the wall of the water outlet.

4. The nozzle of claim 3, in which the diameter of the water outlet downstream of the step is larger than the diameter of the lower disc.

5. The nozzle of claim 3, in which said step is nearer the lower disc than to a bottom of the water outlet.

6. The nozzle of claim 3, in which the syrup spray head has outlets focused on the wall of the water outlet at a point of intersection below the step.

7. An improved carbonated beverage mixing nozzle for a post-mix carbonated beverage dispenser having a carbonated water supply chamber co-axially surrounding a syrup supply port, said nozzle comprising:

(a) a syrup diffuser having an elongate tubular body, said body having a snap-in connector means on an upper end for connection to said syrup supply port, and a spray head in a lower end having outwardly focused outlets for spraying syrup outwardly from the diffuser and into a water outlet for a carbonated water stream around the spray head;

(b) an upper carbonated water distribution disc, said disc having a outer diameter loosely-fitted within the water supply chamber and a plurality of water openings in a circular pattern around the syrup diffuser;

(c) a lower carbonated water distribution disc spaced below the upper disc and immediately above the syrup spray head, said lower disc having an outer diameter having a greater clearance with the water outlet than a similar clearance between the upper disc and the supply chamber, said lower disc having a plurality of water openings in a circular pattern around the syrup diffuser, said lower disc openings having a greater cumulative area than the upper disc openings; and (d) a water plenum chamber between the discs, said plenum chamber having a height greater than its annular width as measured from the syrup diffuser to an inside surface of the water outlet.

8. The nozzle of claim 7, in which the disc openings are rounded edged aperatures bounded by a rounded edged outer diameter of each respective disc.

9. An improved carbonated beverage mixing nozzle in a post-mix carbonated beverage dispenser, having a carbonated water supply chamber co-axially surrounding a syrup supply port, comprising:

(a) a syrup diffuser having an elongate tubular body and a spray head in a lower end for spraying syrup outwardly from the diffuser and into a water stream;

(b) an upper carbonated water distribution disc, said disc having an outer diameter fitted into the water supply chamber and a plurality of water apertures in a circular pattern between the syrup diffuser and the disc outer diameter;

(c) a generally frusto-conical carbonated water spreader underneath the upper disc water apertures, said spreader tapering outwardly and downwardly to an outer diameter that is larger than the largest diameter of the circular pattern of the upper disc water apertures; there being a larger clearance between the spreader and a carbonated water outlet around the spreader, than between the upper disc and the supply chamber;

(d) a lower carbonated water distribution disc immediately above the syrup spray head, said lower disc having an outer diameter with a greater clearance with the water outlet than a clearance between the upper disc and the supply chamber, said lower disc having a plurality of water apertures in a circular pattern between the syrup diffuser and the disc outer diameter, said lower disc apertures having a greater cumulative area than the upper disc apertures; and (e) an inward facing step in the water outlet and underneath the spreader for directing carbonated water flow under the spreader and off of the surface of the water outlet.

10. An improved carbonated beverage mixing nozzle in a post-mix carbonated beverage dispenser, having a carbonated water supply chamber co-axially surrounding a syrup supply port, comprising:

(a) a syrup diffuser having an elongate tubular body and a spray head in a lower end for spraying syrup outwardly from the diffuser and into a water stream;

(b) an upper carbonated water distribution disc, said disc having an outer diameter fitted into the water supply chamber and a plurality of water apertures in a circular pattern between the syrup diffuser and the disc outer diameter;

(c) a generally frusto-conical carbonated water spreader underneath the upper disc water apertures, said spreader tapering outwardly and downwardly to an outer diameter that is larger than the largest diameter of the circular pattern of the upper disc water apertures, there being a larger clearance between the spreader and a carbonated water outlet around the spreader, than between the upper disc and the supply chamber;

(d) a lower carbonated water distribution disc immediately above the syrup spray head, said lower disc having an outer diameter with a greater clearance with the water outlet than a clearance between the upper disc and the supply chamber, said lower disc having a plurality of water apertures in a circular pattern between the syrup diffuser and the disc outer diameter, said lower disc apertures having a greater cumulative area than the upper disc apertures; and (e) in which the cross-sectional area of the water outlet increases from the upper disc apertures to the spreader, then further increases from the spreader to a shoulder under the spreader, then increases in a water plenum below the spreader and shoulder, and then decreases in the lower disc.

11. An improved carbonated beverage mixing nozzle in a post-mix carbonated beverage dispenser having a carbonated water supply chamber co-axially surrounding a syrup supply port, said nozzle comprising comprising:

(a) a syrup diffuser having an elongate tubular body, said body having connector means on an upper end for connection to said syrup supply port, and a spray head in a lower end for spraying syrup outwardly from the diffuser and into a water stream;

(b) an upper carbonated water distribution disc, said disc having an outer diameter within the water supply chamber and a plurality of water openings in a circular pattern around the syrup diffuser;

(c) a lower carbonated water distribution disc spaced below the upper disc and immediately above the syrup spray head, said lower disc having an outer diameter with a greater diametric clearance with the water outlet than a similar clearance between the upper disc and the supply chamber, said lower disc having a plurality of water openings in a circular pattern around the syrup diffuser, said lower disc openings having a greater cumulative area than the upper disc openings;

(d) a water plenum chamber between the discs, said plenum chamber having a height greater than its width as measured from the syrup diffuser to an inside surface of the water outlet; and (e) in which the water outlet between the upper disc and the plenum has a gradually increasing cross-section with the largest section being the entry to the plenum.

* * * * *